United States Patent [19]

Oda

[11] 4,211,994

[45] Jul. 8, 1980

[54] CERAMIC VARISTOR

[75] Inventor: Hiroshi Oda, Hirakata, Japan

[73] Assignee: Matsushita Electric Industrial Co., Ltd., Osaka, Japan

[21] Appl. No.: 965,867

[22] Filed: Dec. 4, 1978

[30] Foreign Application Priority Data

Dec. 9, 1977 [JP] Japan ..... 52/148302

[51] Int. Cl.[2] ..... H01C 7/10

[52] U.S. Cl. ..... 338/21; 338/314

[58] Field of Search ..... 338/21, 314; 29/610; 361/127; 252/518

[56] References Cited

U.S. PATENT DOCUMENTS

| | | | |
|---|---|---|---|
| 1,002,069 | 8/1911 | Marvin, Jr. | 338/21 |
| 2,870,307 | 1/1959 | Milliken et al. | 338/21 |
| 3,227,983 | 1/1966 | Braun | 338/21 |
| 3,824,431 | 7/1974 | Schlicke | 338/21 X |
| 3,913,056 | 10/1975 | Levinson | 338/21 |
| 3,955,168 | 5/1976 | Levinson | 338/21 |

*Primary Examiner*—C. L. Albritton

*Attorney, Agent, or Firm*—Burgess, Ryan & Wayne

[57] ABSTRACT

An overvoltage absorbing element having an improved energy storing capability (withstand energy) and applicable to various fields hereinbefore unapplicable. Ceramic of a polycrystal varistor wherein a sintered body itself has a non-linear voltage characteristic and ceramic having a high electric conductivity are bonded through a metal, and electrodes are formed on the outermost and opposite surfaces.

8 Claims, 3 Drawing Figures

CERAMIC VARISTOR

BACKGROUND OF THE INVENTION

The present invention relates to a ceramic varistor having a capability of storing a great amount of energy.

Voltage-dependent resistors (varistors) having a non-linear voltage-current characteristic are adapted to inhibit an overvoltage encountered by electric equipment.

Recently, ceramic varistors mainly consisting of zinc oxide have been developed and applied in various fields because of their excellent performance. When their applications are further extended, a greater energy storing capability (to be referred to as "withstand energy") is desired. Furthermore, when the applications to general electronic equipment are taken into consideration, it is desired that performance may be maintained while the size is reduced.

The construction of a ceramic varistor is such that a pair of electrodes are formed on opposite surfaces of a sintered body mainly consisting of zinc oxide. Its microstructure is such that boundary layers consisting of additives surround particles of zinc oxide and they are connected in rows and columns. Zinc oxide particles G have a resistivity from 1 to 10 ohm-cm while the boundary layers, a resistivity higher than $10^{10}$ ohm-cm. Therefore, when an overvoltage is applied to the electrodes, almost all of the charges are applied to the boundary layers where they are subjected to the thermal conversion and consumed, whereby the equipment or the like may be protected. A great factor which determines the withstand energy of the ceramic varistor is a thermal capacity of zinc oxide particles. The improvement of the withstand energy is possible by the increase in size of zinc oxide particles. However, because the ceramic techniques are used for the production of the ceramic varistors and because of the effects of the additives and other characteristic items, the expectation for the growth of zinc oxide particles is limited. Furthermore, to this end special means (production steps), are required.

SUMMARY OF THE INVENTION

Accordingly, one of the objects of the present invention is to provide a ceramic varistor having the same effects and performance as obtained when the zinc oxide particles are abnormally enlarged in size.

The construction of the present invention is such that ceramic of a polycrystal varistor wherein a sintered body itself has a non-linear voltage characteristic and ceramic having a high electric conductivity are bonded through a metal, and electrodes are formed on the outermost and opposite surfaces.

DESCRIPTION OF THE PREFERRED EMBODIMENT

Figure 1:
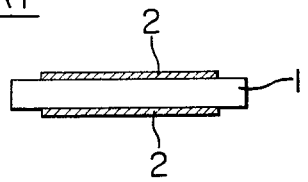
FIG. 1 PRIOR ART
FIG. 1 is a vertical sectional view of a prior art ceramic varistor.
Figure 2:
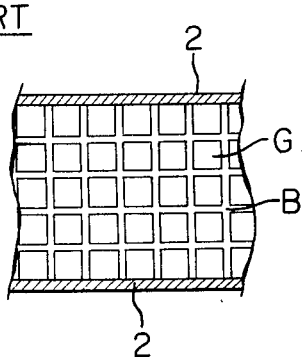
FIG. 2 PRIOR ART
FIG. 2 shows the microstructure thereof.

Referring to FIGS. 1 and 2, a prior art ceramic varistor comprises a sintered body 1 and a pair of electrodes 2 bonded to the opposite surfaces thereof. The sintered body 1 mainly consists of the zinc oxide and has the microstructure as shown in FIG. 2. Particles G of zinc oxide are bounded with boundary layers B consisting of additives. The specific resistivity of the zinc oxide particles G is between 1 to 10 ohm-cm while that of the boundary layers B, is higher than $10^{10}$ ohm-cm. Therefore, when an overvoltage is applied between the electrodes 2, almost all of charges are impressed on the boundary layers B and converted into heat, whereby the equipment or a circuit connected to the varistor may be protected from a breakdown. The most important factor which determines the withstand energy of the varistor is the thermal capacity of the zinc oxide particles G. In general, the greater the size of the zinc oxide particles G, the higher the withstand energy. However, since the ceramic techniques have been used for fabrication of ceramic varistors and because of the effects of additives and other factors, the growth of the zinc oxide particles is limited. In order to increase the particle size of the zinc oxide, special processes are required.

Figure 3:
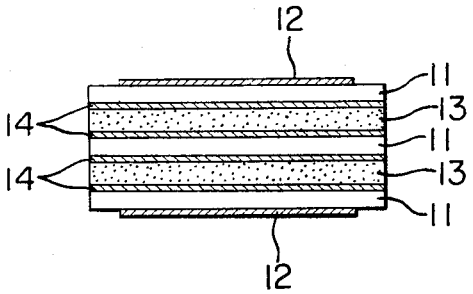
FIG. 3 is a vertical sectional view of a ceramic varistor in accordance with the present invention.

Next, the preferred embodiment of the present invention will be described. Small quantities of bismuth oxide, cobalt oxide, manganese oxide, antimony oxide and chrominum oxide are added to zinc oxide, and they are mixed well. Thereafter, suitable amounts of polyvinyl butylal, dibutylphthalate and organic solvent are added to the mixture of powders to provide a slurry. The slurry is extruded through a die opening into a sheet which is dried. Zinc oxide powder is also formed into a sheet in a manner substantially similar to that described above. A Pt-Pd alloy is printed over the major surfaces of the zinc oxide sheet by the screen printing. Thereafter, as shown in FIG. 3, the zinc oxide sheets 13 with the Pt-Pd alloy layers and the sheets 11 consisting of zinc oxide and additives described above, are alternately overlaid or laminated one over another. The lamination thus formed is subjected to pressing so as to firmly bond the sheets 11 and 13. The lamination is then punched into desired shapes (as for example, disks) and the shapes are sintered at high temperatures. The shapes thus obtained are subjected to the plasma-spray coating or fused flamespray coating so as to form aluminum electrodes 12 over the opposite major surfaces of the sintered lamination.

FIG. 3 shows a vertical cross section of an example of the element thus obtained. 11 is the ceramic of polycrystal varistor wherein the sintered body itself has a non-linear voltage characteristic; 13, the sintered body of zinc oxide; and 14, the layer of the Pt-Pd alloy. In order to evaluate the withstand energy of this element, it was subjected to the rectangular waveform impact current for 2 m-sec. The withstand energy was approximately 2.5 times as high as that of a comparable single-layer ceramic varistor element such as shown in FIG. 1. In the tests, the thickness of the sintered body 1 of zinc oxide was made equal to the sum of the thickness of the ceramic layers 11.

The effects are dependent upon the thickness of individual ceramic layers 11 of the polycrystal varistor and the thickness of the zinc oxide layer 13. When the thickness of the indivisual ceramic layers 11 of the polycrystal varistor is increased too much, these effects are decreased. The Pt-Pd alloy is interposed between the layers in order to minimize the transfusion of the additives from the ceramic layers 11 of the polycrystal varistor into the zinc oxide layers 13.

Even when tin oxide was used instead of zinc oxide as a ceramic having a very high electrical conductivity, the same effects were obtained. However, when other oxides such as nickel oxide, iron oxide and so on and sulfides were used, no desired varistor characteristic was obtained.

Satisfactory effects were obtained when platinum or palladium was used as a metal interposed between the ceramic layers. However, when other metals such as tungsten, molybdenum, gold and so on were used, the corrosion of metals occured and the bonding failed.

When an overvoltage is applied to the element thus obtained, it is thermally converted in the boundary layers B surrounding the zinc oxide particles G, whereby the power consumption is effected. Joule heat is effectively dissipated through the ceramic layers 11 which have a very high thermal conductivity, whereby the withstand energy may be improved. The element is applicable to the power equipment and machines and may be made smaller in size when applied to general electronic equipment. Thus, it is a very useful overvoltage absorbing element.

What is claimed is:

1. A ceramic varistor comprising a polycrystalline sintered ceramic body having non-linear voltage current characteristics, a ceramic body having a high electrical conductivity bonded to said polycrystalline sintered ceramic body having a non-linear voltage current characteristics through a metal, and electrodes formed on outer surfaces of the bodies.

2. A ceramic varistor of claim 1 wherein said polycrystalline sintered ceramic body comprises zinc oxide and an additive selected from the group consisting of oxides of bismuth, cobalt, manganese, antimony, chromium, and mixtures thereof.

3. A ceramic varistor as set forth in claim 1 or 2 wherein said ceramic having a high electric conductivity is zinc oxide.

4. A ceramic varistor as set forth in claim 1 or 2 wherein said ceramic having a high electric conductivity consists of tin oxide.

5. A ceramic varistor as set forth in claim 1 or 2 wherein said metal is a metal selected from the group consisting of platinum, palladium and alloys thereof.

6. A ceramic varistor as set forth in claim 1 wherein a ceramic material of a polycrystal varistor and a ceramic material having a high electric conductivity are formed individually, bonded together through a metal and sintered.

7. A ceramic varistor as set forth in claim 3 wherein said metal is a metal selected from the group consisting of platinum, palladium or an alloy thereof.

8. A ceramic varistor as set forth in claim 4 wherein said metal is a metal selected from the group consisting of platinum, palladium and alloys thereof.

* * * * *